US009676574B2

(12) United States Patent
Lee et al.

(10) Patent No.: US 9,676,574 B2
(45) Date of Patent: Jun. 13, 2017

(54) IMAGE FORMING APPARATUS AND METHOD OF CONTROLLING THE SAME

(71) Applicant: SAMSUNG ELECTRONICS CO., LTD., Suwon-si, Gyeonggi-do (KR)

(72) Inventors: Jae Wuk Lee, Suwon-si (KR); Je Won Jeong, Seoul (KR); Sang Cheol Kim, Hwaseong-si (KR); Jin Soo Lee, Yongin-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 14/488,674

(22) Filed: Sep. 17, 2014

(65) Prior Publication Data

US 2015/0108710 A1 Apr. 23, 2015

(30) Foreign Application Priority Data

Oct. 17, 2013 (KR) ..... 10-2013-0123980

(51) Int. Cl.
*B65H 7/20* (2006.01)
*B65H 7/14* (2006.01)
(Continued)

(52) U.S. Cl.
CPC ..... *B65H 7/20* (2013.01); *B65H 3/0669* (2013.01); *B65H 3/0684* (2013.01); *B65H 5/068* (2013.01);
(Continued)

(58) Field of Classification Search
CPC ..... B65H 7/14; B65H 7/20; B65H 2513/50; B65H 2513/51; B65H 2513/512;
(Continued)

(56) References Cited

U.S. PATENT DOCUMENTS 8,070,152 B2 * 12/2011 Miwa ..... B65H 3/0684 271/10.03
2008/0111294 A1 * 5/2008 Itoh ..... B65H 3/565 271/10.09
(Continued)

FOREIGN PATENT DOCUMENTS

EP 0 400 941 A2 5/1990
EP 0 400 941 A3 5/1990
JP 60-236954 11/1985

OTHER PUBLICATIONS

Extended European Search Report dated Mar. 23, 2015 in corresponding European Patent Application No. 141871590.0/.

*Primary Examiner* — Patrick Cicchino
(74) *Attorney, Agent, or Firm* — Staas & Halsey LLP

(57) ABSTRACT

An image forming apparatus and a method of controlling the same capable of obtaining the same effect as when sheets of paper are picked up in such a state that front ends thereof are all aligned by controlling paper feeding based on results of detecting paper movement and capable of improving feeding speed by maintaining a time taken for the sheet of paper to move to a feed roller constant are provided. The apparatus includes a pick-up roller to pick up a sheet of paper, a forward roller to feed the picked-up sheet of paper toward a downstream side of a paper moving path, a feed roller to feed the sheet of paper fed by the forward roller toward the downstream side of the paper moving path, and a feed sensor mounted between the forward roller and the feed roller to detect movement of the sheet of paper.

19 Claims, 11 Drawing Sheets

(51) Int. Cl.
*G03G 15/00* (2006.01)
*B65H 3/06* (2006.01)
*B65H 5/06* (2006.01)

(52) U.S. Cl.
CPC ..... *B65H 7/14* (2013.01); *G03G 15/6511* (2013.01); *G03G 15/6558* (2013.01); *G03G 15/6564* (2013.01); *B65H 2513/512* (2013.01); *B65H 2513/514* (2013.01); *B65H 2513/53* (2013.01)

(58) Field of Classification Search
CPC ..... B65H 2513/514; B65H 2513/53; B65H 2701/1311; B65H 2701/1313
USPC ..... 271/4.03
See application file for complete search history.

(56) References Cited

U.S. PATENT DOCUMENTS

| | | | | |
|---|---|---|---|---|
| 2009/0166965 | A1* | 7/2009 | Fukasawa | B65H 3/0684 271/265.03 |
| 2010/0239343 | A1* | 9/2010 | Nukumi | B65H 3/44 399/388 |
| 2011/0236041 | A1* | 9/2011 | Kowase | G03G 15/6564 399/20 |
| 2012/0155942 | A1* | 6/2012 | Hayashi | G03G 15/6567 399/388 |
| 2013/0043647 | A1* | 2/2013 | Fujii | G03G 15/6564 271/226 |

* cited by examiner

IMAGE FORMING APPARATUS AND METHOD OF CONTROLLING THE SAME

CROSS-REFERENCE TO RELATED APPLICATIONS

This application is related to, and claims the priority benefit of, Korean Patent Application No. 2013-0123980, filed on Oct. 17, 2013 in the Korean Intellectual Property Office, the disclosure of which is incorporated herein by reference.

BACKGROUND

1. Field

Embodiments relate to an image forming apparatus and a method of controlling the same, and more particularly to a paper feeding device and feeding method to feed sheets of paper loaded in a paper container to an image forming engine to perform a print task.

2. Description of the Related Art

Print speed and print quality are recognized important items in evaluating the performance of an image forming apparatus. Print speed, which is generally represented in Pages Per Minute (PPM), is a major factor indicating the performance of an image forming apparatus. Manufacturers are striving to develop technologies to increase print speed.

Important factors influencing print speed of an image forming apparatus include not only an image forming speed, but also a speed at which paper to be printed upon is fed, i.e., a paper feeding speed. For example, methods of achieving a high paper feeding speed may include increasing a paper moving speed and decreasing a feeding interval between a preceding sheet of paper and a succeeding sheet of paper. In other words, a paper feeding speed may increase as the time wasted between two successive sheets of paper is reduced when plural sheets of paper are successively fed.

SUMMARY

It is an aspect to provide an image forming apparatus, and a method of controlling the same, capable of obtaining the same effect as when sheets of paper are picked up in such a state that front ends of all the sheets of paper are evenly aligned by controlling paper feeding based on results of detecting paper movement by a feed sensor, and capable of improving a feeding state and feeding speed by maintaining a time taken for the sheet of paper in a paper container to move to a feed roller constant.

Additional aspects are set forth in part in the description that follows and, in part, will be obvious from the description, or may be learned by practice of the invention.

In accordance with an aspect, an image forming apparatus includes a pick-up roller to pick up a sheet of paper loaded in a paper container, a forward roller to feed the sheet of paper picked up by the pick-up roller toward a downstream side of a paper moving path, a feed roller to feed the sheet of paper fed by the forward roller toward the downstream side of the paper moving path, and a feed sensor mounted between the forward roller and the feed roller to detect movement of the sheet of paper moving from the forward roller to the feed roller.

The feed sensor may be mounted apart from the forward roller and the feed roller by respective predetermined distances within a region between the forward roller and the feed roller.

The predetermined distances may include a predetermined first distance that is set from the forward roller toward the downstream side of the paper moving path, and a predetermined second distance that is set from the feed roller toward an upstream side of the paper moving path.

The predetermined first distance may correspond to a maximum value by which a front end of the sheet of paper passing through the forward roller sticks out past the forward roller toward the downstream side of the paper moving path.

The predetermined second distance may correspond to a maximum time taken until a motor driving the pick-up roller is stopped.

The motor driving the pick-up roller may be stopped when rotational inertia of the motor is stopped after power supplied to the motor is cut off.

The feed sensor may be configured to detect movement of the sheet of paper by irradiating light and receiving the light reflected from a surface of the sheet of paper.

The feed sensor may be configured to generate detection signals by detecting a front end and rear end of the sheet of paper.

The image forming apparatus may further include a transfer roller to form an image on the sheet of paper by pressurizing the sheet of paper fed by the feed roller against a transfer body.

The transfer roller may be disposed at the downstream side of the paper moving path apart from the feed roller.

In accordance with an aspect, a method of controlling an image forming apparatus includes picking up a sheet of paper by performing first operation of a pick-up roller, detecting a front end of the picked-up sheet of paper moving from a forward roller to a feed roller, stopping movement of the sheet of paper by terminating the first operation of the pick-up roller when a predetermined first time passes since the front end of the sheet of paper is detected, and feeding the picked-up sheet of paper toward a downstream side of a paper moving path by performing second operation of the pick-up roller when a predetermined second time passes since a starting point of time of the first operation of the pick-up roller.

The front end of the sheet of paper may reach the feed roller by the second operation of the pick-up roller.

The method may include terminating the second operation of the pick-up roller when a predetermined third time passes since the starting point of time of the first operation of the pick-up roller, and feeding the sheet of paper toward the downstream side of the paper moving path using the feed roller.

The predetermined second time may be longer than the predetermined first time.

The predetermined third time may be longer than the predetermined second time.

A feed sensor is mounted between the forward roller and the feed roller, and the feed sensor may be mounted apart from the forward roller and the feed roller by respective predetermined distances within a region between the forward roller and the feed roller.

The predetermined distances may include a predetermined first distance that is set from the forward roller toward the downstream side of the paper moving path, and a predetermined second distance that is set from the feed roller toward an upstream side of the paper moving path.

The predetermined first distance may correspond to a maximum value by which a front end of the sheet of paper passing through the forward roller sticks out past the forward roller toward the downstream side of the paper moving path.

The predetermined second distance may correspond to a maximum time taken until a motor driving the pick-up roller is stopped.

The motor driving the pick-up roller is stopped when rotational inertia of the motor is stopped after power supplied to the motor is cut off.

A same effect as when sheets of paper are picked up in such a state that front ends of all the sheets of paper are evenly aligned may be obtained by controlling paper feeding based on results of detecting paper movement by the feed sensor. Further, a feeding state and feeding speed may be improved by maintaining a time taken for the sheet of paper in the paper container to move to the feed roller constant.

BRIEF DESCRIPTION OF THE DRAWINGS

These and/or other aspects of the invention will become apparent and more readily appreciated from the following description of the embodiments, taken in conjunction with the accompanying drawings of which.

DETAILED DESCRIPTION

Figure 1:
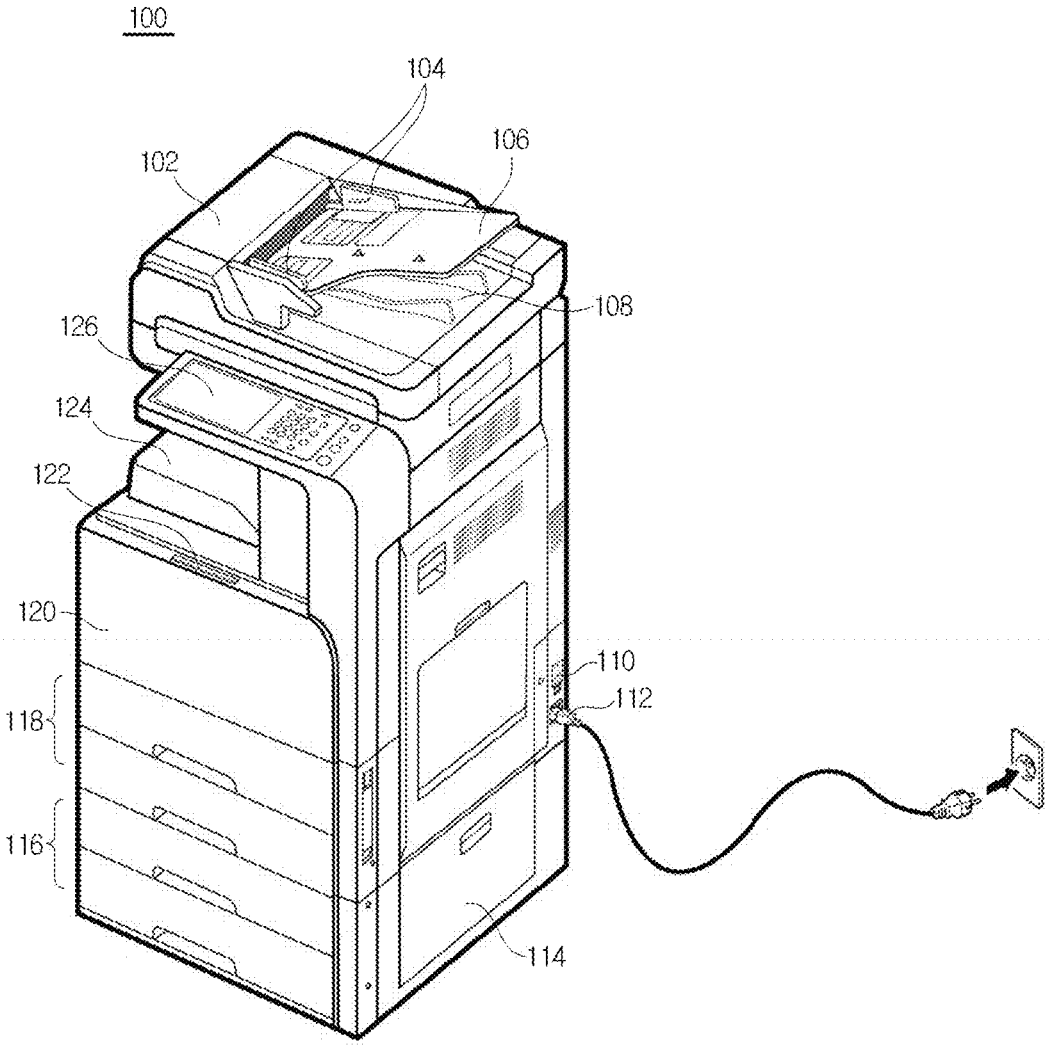
FIG. 1 is a view illustrating an image forming apparatus according to an exemplary embodiment.

Reference will now be made in detail to the embodiments, examples of which are illustrated in the accompanying drawings, wherein like reference numerals refer to like elements throughout.

FIG. 1 is a view illustrating an image forming apparatus according to an embodiment. An external appearance of an image forming apparatus 100 according to an embodiment is described with reference to FIG. 1.

An image forming apparatus 100 comprises an automatic document feeder 102 provided, for example, at an upper portion thereof. The automatic document feeder 102 is a device that is optionally added, and may be removed from the image forming apparatus 100. The automatic document feeder 102 may feed a large number of documents to the image forming apparatus 100 sheet by sheet. For example, when scanning, copying or faxing a large number of documents, the document may be rapidly fed to the image forming apparatus 100 by the automatic document feeder 102. Such an automatic document feeder 102 includes a document width guide 104, a document input tray 106 and a document output tray 108. The document width guide 104 guides both sides (in a main-scanning direction) of a document to be fed so that the document is smoothly fed into the image forming apparatus 100 in a designated direction. The document input tray 106 may be configured to receive a document to be fed into the image forming apparatus 100. The document received on the document input tray 106 is fed into the image forming apparatus 100 by operation of a document pickup device and rollers. The document output tray 108 may be configured to receive the document that is discharged from the image forming apparatus 100 after being fed into the image forming apparatus 100 from the document input tray 106 and undergoing a scanning process in the image forming apparatus 100.

A power switch 110 may be provided, for example, at a right side portion of the image forming apparatus 100. The power switch 110 allows commercial AC power of 110V or 220V supplied through a power cord 112 to be converted in phase, voltage and frequency through a power supply unit of the image forming apparatus 100 and supplied to each electronic component of the image forming apparatus 100.

A second paper container cover 114 may be provided, for example, at a side portion of a second paper container (e.g., second cassette feeder) 116. In addition to a main paper container (e.g., main cassette feeder) 118 provided at the image forming apparatus 100 to contain standard size paper, the second paper container 116 may be selectively added. Both the main paper container 118 and the second paper container 116 considerably increase paper capacity.

A cover, e.g., front cover 120 may be provided at a front portion of the image forming apparatus 100. The front cover 120 may be opened when performing maintenance on a laser scanning unit, a waste toner box, a toner cartridge, an imaging unit and the like. The front cover 120 may be opened using a front cover knob 122.

A paper output tray 124 may be configured to receive paper that is discharged from the image forming apparatus 100 after an image is printed thereon.

A manipulation device 126 includes a display unit, a status LED and a key input unit. The key input unit includes a plurality of number buttons, function buttons, menu buttons and command buttons.

Figure 2:
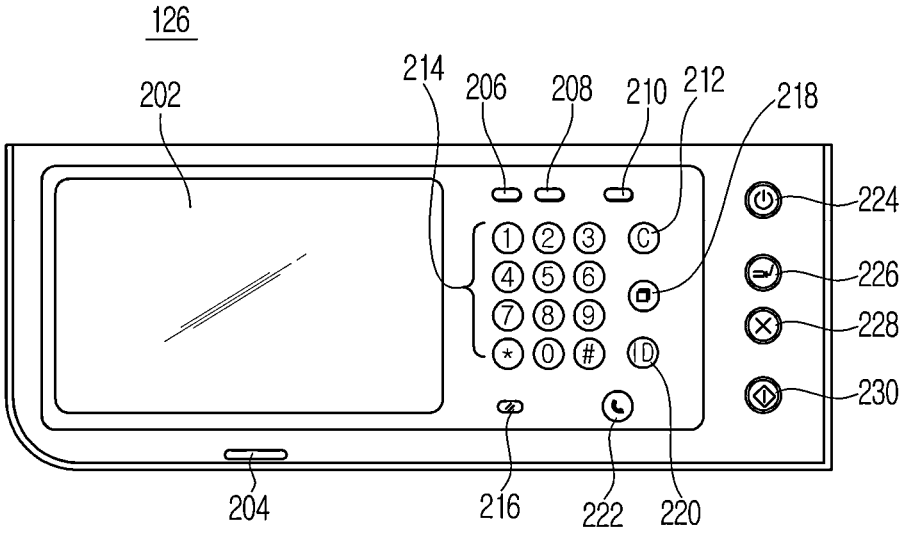
FIG. 2 is a view illustrating a manipulation device of the image forming apparatus according to the exemplary embodiment.

FIG. 2 is a view illustrating a manipulation device of the image forming apparatus according to an embodiment. As illustrated in FIG. 2, the manipulation device 126 includes a display unit 202, a status LED 204, an operation status button 206, a counter button 208, an eco button 210, a delete button 212, a number button 214, a return button 216, a redial/pause button 218, a login/logout button 220, an on hook dial button 222, a power button 224, an urgent copy button 226, a stop button 228 and a start button 230.

The display unit 202 may be configured to display a current status of the image forming apparatus 100 and a screen requesting a user's response during the operation. A user may set an operational menu through the display unit 202.

The status LED 204 may be configured to display a current status of the image forming apparatus 100, for example, by change in color and flickering. A difference between the display unit 202 and the status LED 204 may include that the display unit 202 displays concrete status information and provides two-way communication with a user, but the status LED 204 simply and unilaterally displays a status of the image forming apparatus 100 by a change in color and flickering.

In response to user manipulation, the operation status button 206 displays currently performed tasks, pending tasks, completed tasks, error codes or security tasks on the display unit 202.

In response to user manipulation, the counter button 208 may display the accumulated number of sheets of paper that have been used in the image forming apparatus 100 until the present time.

The eco button 210, in response to user manipulation, s may forcibly perform a power saving mode (eco mode) for energy saving.

The delete button 212, in response to user manipulation, may delete characters, numbers and symbols in an editing area. For example, if a user inputs the wrong number of sheets of paper to be copied, they may use the delete button 212 to correct this. If a user inputs the wrong fax number, they may use the delete button 212 to correct this.

Using the number button 214, a user enters a phone or fax number or inputs other numbers or characters. A user may input the number of sheets of paper to be printed or numbers for other options through the number button 214.

The return button 216, in response to user manipulation, may initialize the present setting of the image forming apparatus 100. For example, when the number of copies and copy darkness have been set to a certain value in a copy mode, if a user presses the return button 216, the number of copies is initialized to zero and the copy darkness is initialized to a median value.

The redial/pause button 218, in response to user manipulation, may redial the most recently dialed fax number or received fax number in a standby mode or insert a pause (-) into a fax number in an edit mode.

The login/logout button 220, in response to user manipulation, may allow a user to log in to the image forming apparatus 100 or to log out of the image forming apparatus 100.

The on hook dial button 222, in response to user manipulation, may make a dial tone sound from a speaker.

The power button 224 allows a user to turn the image forming apparatus 100 on or off. If the light of the status LED 204 is blue, the power of the image forming apparatus 100 is in an on state. If a user wants to turn off the image forming apparatus 100, they may press the power button 224, for example, for about three seconds or more.

If a user presses the urgent copy button 226, the currently performed task may be interrupted to perform urgent copy.

The stop button 228, in response to user manipulation, may stop the currently performed task. So that a user can select stop or restart, a pop-up window showing information regarding the currently performed task is displayed on the display unit 202.

The start button 230, in response to user manipulation, may start the currently set task.

Figure 3:
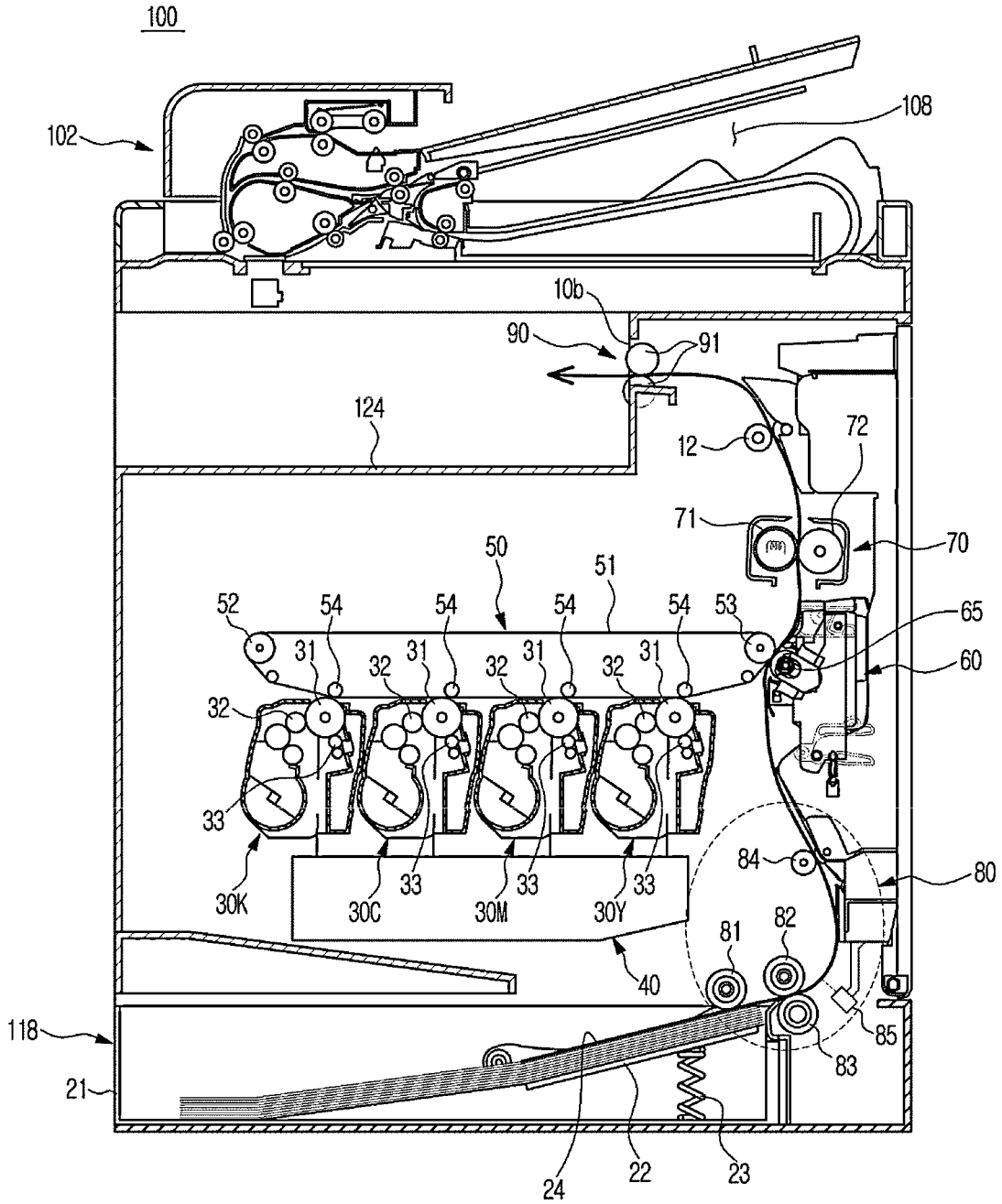
FIG. 3 is a view illustrating an internal structure of the image forming apparatus according to the exemplary embodiment.

FIG. 3 is a view illustrating an interior structure of the image forming apparatus according to the exemplary embodiment. The image forming apparatus 100 according to an exemplary embodiment includes a plurality of developing units 30C, 30M, 30Y and 30K to develop an electrostatic latent image into a visible image through developer (e.g., toner), an exposure unit 40 to form the electrostatic latent image on a photosensitive body 31 of each charged developing unit 30C, 30M, 30Y or 30K, a transfer device 50 to receive each sheet of paper 24 from the main paper container 118 so as to transfer the visible image formed on the photosensitive body 31 to the sheet of paper 24, and a fixing unit 70 to fix the developer transferred to the sheet of paper 24.

The paper output tray 124 may be provided, at one side thereof, with a discharge port 10*b* to discharge the sheet of paper 24 upon which image formation has been completed.

The main paper container 118 includes a tray 21, a knock-up plate 22 disposed in the tray 21 to load the sheets of paper 24, and an elastic member 23 to elastically support the knock-up plate 22.

Each of the developing units 30C, 30M, 30Y and 30K includes a photosensitive body 31 formed, on a charged surface thereof, with the electrostatic latent image by the exposure unit 40, a developing roller 32 to supply the developer to the photosensitive body 31, and a charging roller 33 to charge the surface of the photosensitive body 31.

In an exemplary embodiment, the developing unit is comprised of four developing units 30C, 30M, 30Y and 30K that store different colors of developers, for example, cyan C, magenta M, yellow Y and black K, respectively, to develop the images of cyan C, magenta M, yellow Y, and black K. The four developing units 30C, 30M, 30Y and 30K are arranged parallel with one another beneath the transfer device 50 and 60.

The exposure unit 40 irradiates light including image information to the photosensitive body 31 provided at each developing unit 30C, 30M, 30Y or 30K to form the electrostatic latent image on the surface of the photosensitive body 31.

The transfer device 50 and 60 includes a first transfer unit 50 to which the visible image formed by the developer is transferred from the developing units 30C, 30M, 30Y and 30K, and a second transfer unit 60 to transfer the visible image on the first transfer unit 50 to the sheet of paper 24. The second transfer unit 60 includes a transfer roller 65.

The fixing unit 70 includes a heating roller 71 to generate heat, and a pressure roller 72 having a peripheral surface that is made of an elastically deformable material to press the sheet of paper 24 against a peripheral surface of the heating roller 71.

The image forming apparatus 100 may be provided with a pick-up unit 80 arranged at an upper portion of one side of the main paper container 118 to pick up the sheet of paper 24 loaded on the knock-up plate 22 sheet by sheet, delivery rollers 12 to guide the sheet of paper 24 picked up by the pick-up unit 80 upward, and a discharge unit 90 arranged above the fixing unit 70 while being arranged at a portion adjacent to the discharge port 10*b* so that the sheet of paper 24 passing through the fixing unit 70 is discharged through the discharge port 10*b*. The pick-up unit 80 includes a pick-up roller 81, a forward roller 82, a retard roller 83, a feed roller 84 and a feed sensor 85. The discharge unit 90 includes a pair of discharge rollers 91 arranged within the discharge port 10*b*. In the pick-up unit 80, the pick-up roller 81 picks up the sheet of paper 24 on the knock-up plate 22 sheet by sheet. Picking up the sheet of paper 24 may be defined as making the sheet of paper 24 start to move by applying external force to the sheet of paper 24 so that the sheet of paper 24 loaded in a stationary state moves along a moving path. External force to pick up the sheet of paper 24 may be a rotational force of the pick-up roller 81. The forward roller 82 makes the sheet of paper 24 picked up by the pick-up roller 81 move forward so that a front end of the sheet of paper 24 reaches at least the feed roller 84. When the plural overlapped sheets of paper 24 pass between the forward roller 82 and the retard roller 83, the retard roller 83 rotates slowly or backward while the forward roller 82 rotates forward so that the uppermost sheet of paper of the plural overlapped sheets of paper is allowed to normally move along the moving path by the forward rotation of the forward roller 82 and the lowermost sheet of paper is separated from the uppermost sheet of paper and prevented from passing between the forward roller 82 and the retard roller 83 by the slow rotation or backward rotation of the retard roller 83. A forward rotational direction of the forward roller 82 and the retard roller 83 is a rotational direction to move the picked-up sheet of paper 24 toward a transfer belt 51 along the moving path, and a backward rotational direction of the forward roller 82 and the retard roller 83 is an opposite direction to the forward rotational direction. The pick-up roller 81, the forward roller 82 and the retard roller 83 do not rotate independently but rotate interlockingly by receiving power from one motor. The feed roller 84 receives the front end of the sheet of paper 24 passing through the forward roller 82 and the retard roller 83 and moves the sheet of paper 24 to the image forming unit (e.g., the transfer device 50 and 60) disposed at a downstream side of the paper moving path. Before a rear end of the sheet of paper 24 passes through the forward roller 82 and the retard roller 83, the front end of the sheet of paper 24 is fitted in the feed roller 84. Since movement of the sheet of paper 24 by the forward roller 82 may be followed by movement of the sheet of paper 24 by the feed roller 84, movement of the sheet of paper 24 is performed constantly. The feed sensor 85 generates a detection signal by detecting the front end and rear end of the sheet of paper 24 passing between the forward roller 82 and the feed roller 84 (refer to FIG. 4). In the image forming apparatus 100 according to an exemplary embodiment, only one feed sensor 85 is used to detect the front end of the sheet of paper 24 moving by the forward roller 82 and the retard roller 83 and the rear end of the sheet of paper 24 moving by the feed roller 84.

In an exemplary image forming apparatus 100, the first transfer unit 50 includes a transfer belt 51 that is an intermediate transfer body to which the developer developed on the photosensitive bodies 31 of the developing units 30C, 30M, 30Y and 30K in the form of a visible image is transferred in an overlapping manner, a driving roller 52 and a driven roller 53 disposed at both sides of the transfer belt 51, respectively, to rotate the transfer belt 51, a plurality of transfer rollers 54 disposed opposite to the photosensitive bodies 31 of the developing units 30C, 30M, 30Y and 30K while interposing the transfer belt 51 therebetween to transfer the visible image formed on the photosensitive bodies 31 to the transfer belt 51, and a transfer belt frame (not illustrated) to which both end portions of the transfer rollers 54, both end portions of the driving roller 52 and both end portions of the driven roller 53 are rotatably mounted.

Figure 4A:
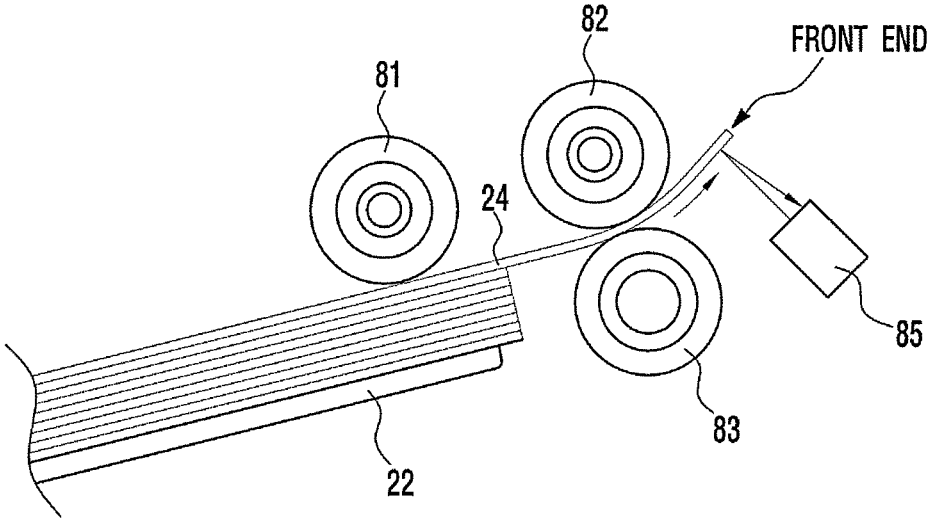
FIGS. 4A-4B illustrate paper detection operation of a feed sensor in the image forming apparatus according to an exemplary embodiment.
Figure 4B:
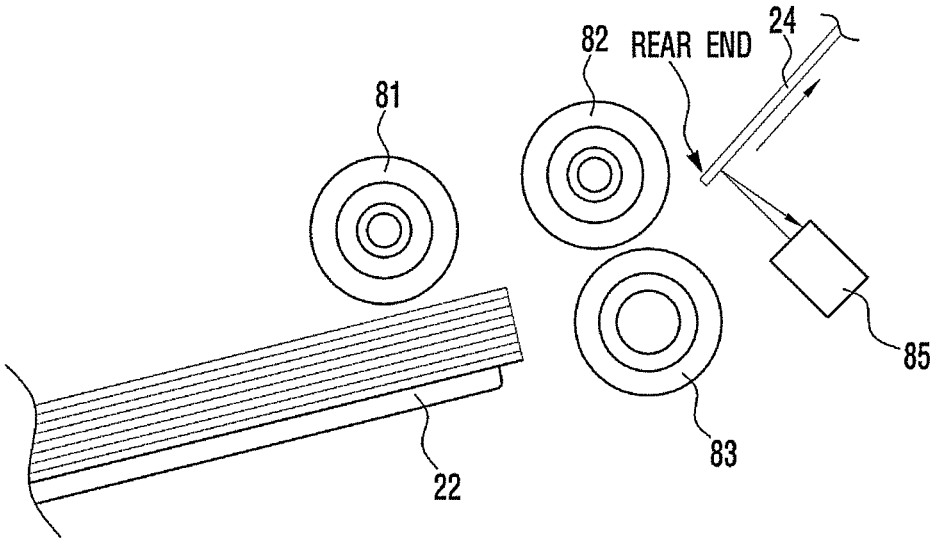

FIGS. 4A-4B illustrate paper detection operation of the feed sensor in the image forming apparatus according to the exemplary embodiment. The feed sensor 85 is mounted near the paper moving path and may be positioned between the forward roller 82 and the feed roller 84. The position of the feed sensor 85 is a position capable of detecting the front end and rear end of the sheet of paper 24 moving between the forward roller 82 and the feed roller 84. As illustrated in FIGS. 4A-4B, the feed sensor 85 generates detection signals upon detecting the front end and rear end of the sheet of paper 24 moving between the forward roller 82 and the feed roller 84. The feed sensor 85 may be a reflection type sensor, which irradiates light in a predetermined direction, and receives light reflected from the surface of the sheet of paper 24 passing through the optical path of the feed sensor 85, and detects whether the front end and rear end of the sheet of paper 24 pass by the detection position of the feed sensor 85 based on the received light.

FIG. 4A illustrates an exemplary operation of the feed sensor 85 detecting the front end of the sheet of paper 24. As illustrated in FIG. 4A, before the front end of the sheet of paper 24 passes through the optical path of the feed sensor 85, detection of the front end of the sheet of paper 24 by the feed sensor 85 is not achieved. As the front end of the sheet of paper 24 enters the optical path of the feed sensor 85, the feed sensor 85 detects the front end of the sheet of paper 24 and generates a detection signal corresponding thereto, thereby informing that the front end of the sheet of paper 24 passes by the optical path of the feed sensor 85. FIG. 4B illustrates an exemplary operation of the feed sensor 85 detecting the rear end of the sheet of paper 24. As illustrated in FIG. 4B, paper detection operation of the feed sensor 85 may be performed continuously until the rear end of the sheet of paper 24 exits the optical path of the feed sensor 85. After the rear end of the sheet of paper 24 exits the optical path of the feed sensor 85, the light irradiated from the feed sensor 85 is not reflected by the sheet of paper 24 any longer, and thus detection of the sheet of paper 24 is terminated. In other words, as illustrated in FIGS. 4A-4B, the feed sensor 85 detects passing of the front end of the sheet of paper 24 from conversion of "non-reflection→reflection" of the light irradiated from the feed sensor 85, and detects passing of the rear end of the sheet of paper 24 from conversion of "reflection→non-reflection" of the light irradiated from the feed sensor 85.

Figure 5:
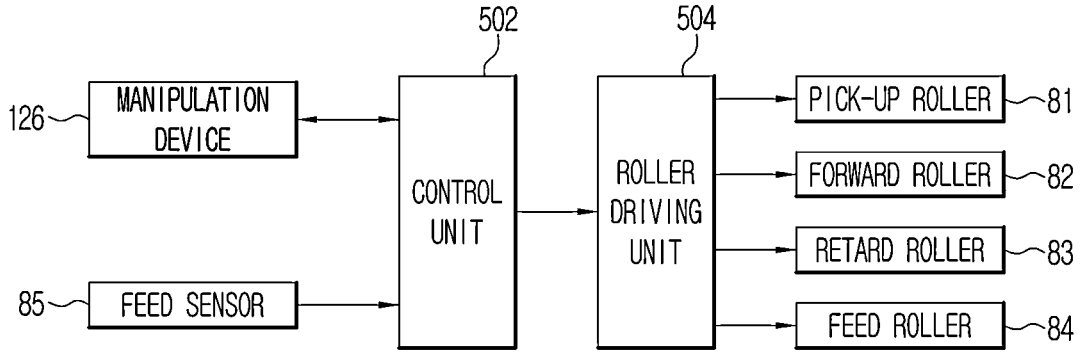
FIG. 5 is a control block diagram of the image forming apparatus according to an exemplary embodiment.

FIG. 5 is a control block diagram of the image forming apparatus according to an exemplary embodiment. The control system of the image forming apparatus illustrated in FIG. 5 is configured to control the pick-up roller 81, the forward roller 82, the retard roller 83 and the feed roller 84 based on the results of detecting the front end and rear end of the sheet of paper 24 using the feed sensor 85 of the pick-up unit 80.

As illustrated in FIG. 5, an input terminal of a control unit 502 to control overall operation of the image forming apparatus 100 may be communicatively connected to the manipulation device 126 and the feed sensor 85, and an output terminal of the control unit 502 is communicatively connected to a roller driving unit 504. An exemplary manipulation device 126 was described above with reference to FIG. 3, and a feed sensor 85 was described above with reference to FIGS. 2 and 4. The roller driving unit 504 connected to the output terminal of the control unit 502 may be configured to drive the pick-up roller 81, the forward roller 82, the retard roller 83 and the feed roller 84 according to control commands from the control unit 502. The control unit 502 illustrated in FIG. 5 controls the pick-up roller 81, the forward roller 82, the retard roller 83 and the feed roller 84 based on the moving state of the sheet of paper 24 detected by the feed sensor 85, to thereby shorten the paper feeding time and stabilize paper feeding state.

Figure 6:
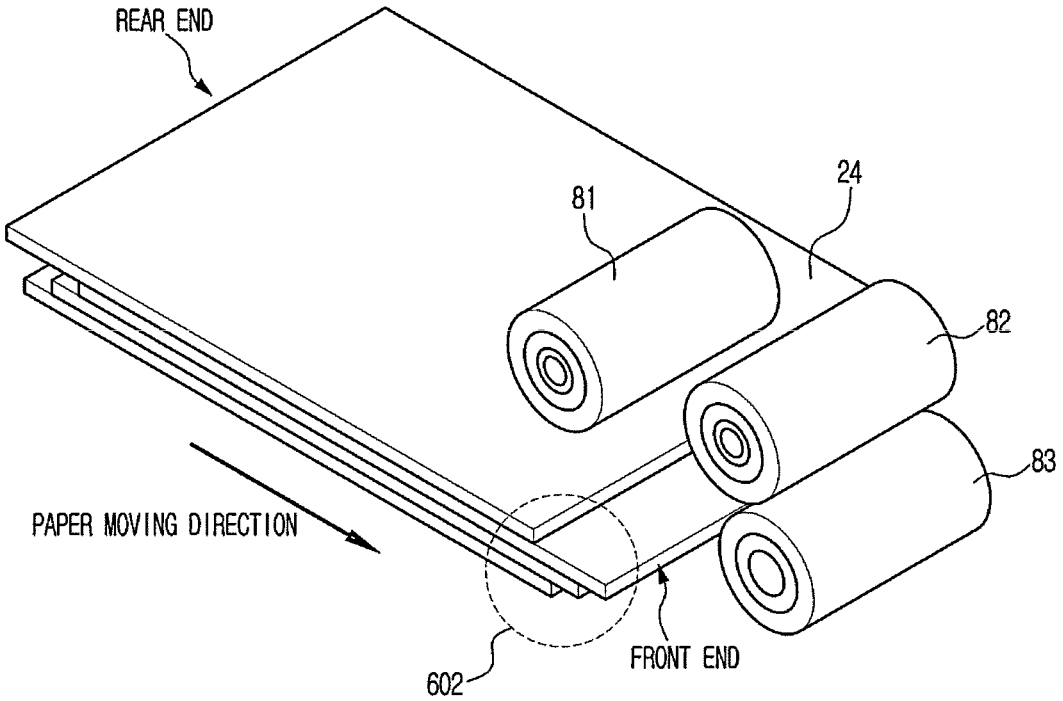
FIG. 6 is a view illustrating a state wherein front ends of sheets of paper are not aligned in the image forming apparatus according to an exemplary embodiment.

FIG. 6 is a view illustrating a state wherein the front ends of the sheets of paper are not aligned in the image forming apparatus according to the exemplary embodiment. As illustrated in FIG. 6, when the sheets of paper 24 loaded on the knock-up plate 22 of the main paper container 118 are picked up by the pick-up roller 81 and move toward the forward roller 82, the front ends of the sheets of paper 24 may be in a misaligned or uneven state as denoted by reference numeral 602 in FIG. 6. If the sheets of paper 24 are fed under the condition that the front ends thereof are misaligned or uneven, a feeding interval is not uniform. As a result, a feeding speed is decreased and feeding operation is destabilized.

Figure 7:
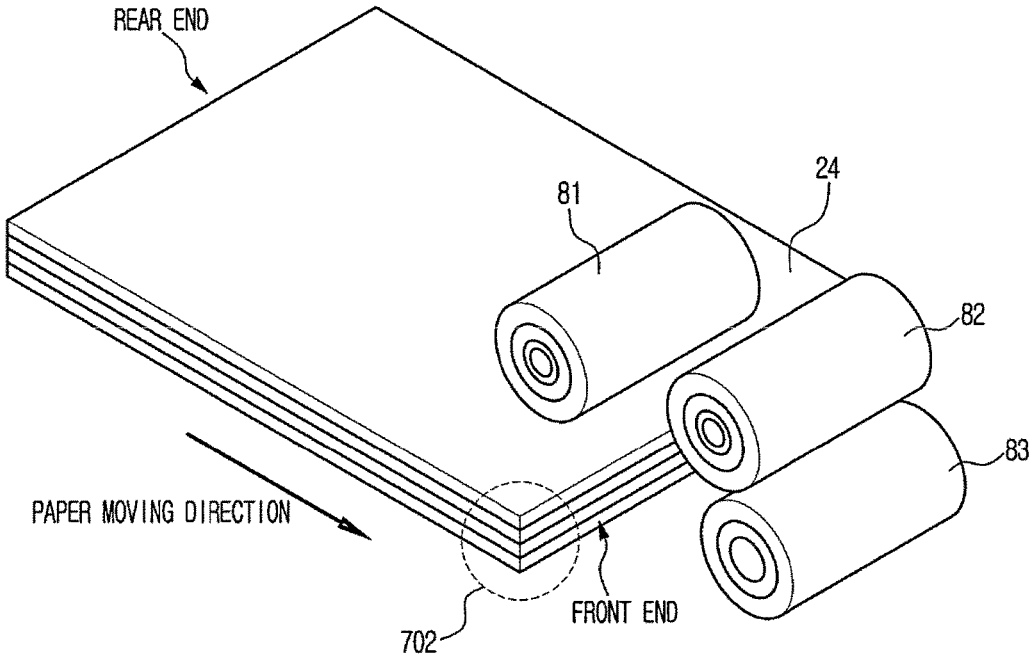
FIG. 7 is a view illustrating a state wherein the front ends of the sheets of paper are aligned in the image forming apparatus according to an exemplary embodiment.

FIG. 7 is a view illustrating a state wherein the front ends of the sheets of paper are aligned in the image forming apparatus according to the exemplary embodiment. As illustrated in FIG. 7, when the sheets of paper 24 loaded on the knock-up plate 22 of the main paper container 118 are picked up by the pick-up roller 81 and move toward the forward roller 82, if the front ends of the sheets of paper 24 are aligned as denoted by reference numeral 702 in FIG. 7, the front ends of the sheets of paper 24 are always fed from the same position. If the sheets of paper 24 are fed under the condition that the front ends thereof are in an aligned state, a feeding interval becomes uniform. As a result, a feeding speed is increased and feeding operation is stabilized.

In the image forming apparatus and the method of controlling the same according to the exemplary embodiment, since the pick-up roller 81, the forward roller 82, the retard roller 83 and the feed roller 84 are controlled based on the moving state of the sheet of paper 24 detected by the feed sensor 85, although the sheets of paper 24 are fed under the condition that the front ends thereof are in a misaligned or uneven state as illustrated in FIG. 6, a feeding speed is increased and feeding operation is stabilized as when the sheets of paper 24 are fed in an aligned state illustrated in FIG. 7.

Figure 8:
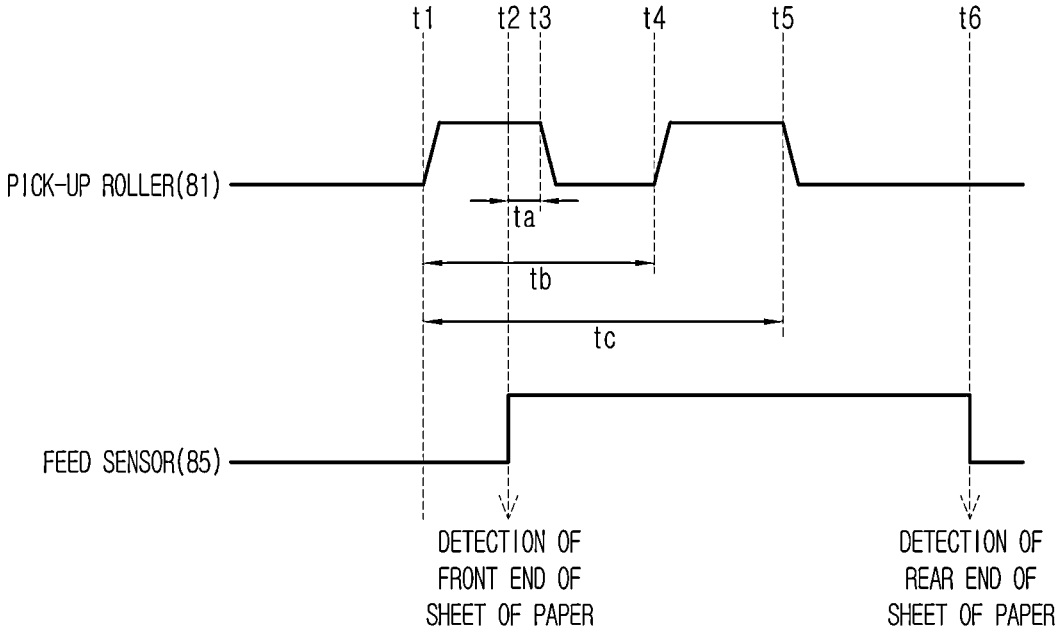
FIG. 8 is a view illustrating a control signal and a detection signal to feed one sheet of paper in the image forming apparatus according to an exemplary embodiment.

FIG. 8 is a view illustrating a control signal and a detection signal to feed a sheet, for example, one sheet of paper in the image forming apparatus according to the exemplary embodiment. In FIG. 8, an upper control signal represents a control signal for the pick-up roller 81, and a lower control signal represents a detection signal from the feed sensor 85. As illustrated in FIG. 8, to feed the sheet of paper 24 loaded in the main paper container 118 toward the transfer belt 51, the control unit 502 controls the pick-up roller 81 to perform first operation (t1 through t3 in FIG. 8) so that the sheet of paper 24 loaded on the knock-up plate 22 of the main paper container 118 is picked up (t1 in FIG. 8). Picking-up the sheet of paper 24 may be defined as making the sheet of paper 24 loaded in a stationary state start to move along the moving path by applying external force to the sheet of paper 24. The external force to pick up the sheet of paper 24 is rotational force of the pick-up roller 81. The front end of the picked-up sheet of paper 24 is inserted between the forward roller 82 and the retard roller 83 by operation of the pick-up roller 81. If the front end of the sheet of paper 24 picked up by the pick-up roller 81 is inserted between the forward roller 82 and the retard roller 83, the control unit 502 drives the pick-up roller 81 continuously so that the picked-up sheet of paper 24 keeps moving. Since the pick-up roller 81, the forward roller 82 and the retard roller 83 rotate interlockingly by a single motor, when the pick-up roller 81 is driven, both the forward roller 82 and the retard roller 83 are also driven.

If the plural overlapped sheets of paper 24 are simultaneously inserted between the forward roller 82 and the retard roller 83, the control unit 502 controls the retard roller 83 to rotate slowly or backward while the forward roller 82 rotates forward, so that the overlapped sheets of paper 24 are separated and only the uppermost sheet of paper passes between the forward roller 82 and the retard roller 83.

When the front end of the sheet of paper 24 picked up by the first operation of the pick-up roller 81 passes between the forward roller 82 and the retard roller 83 and moves by a predetermined distance and passes by the detection point of the feed sensor 85, the front end of the sheet of paper 24 is detected by the feed sensor 85 (t2 in FIG. 8). Subsequently, if a predetermined first time (ta=t3−t2) passes from the point of time t2 when the front end of the sheet of paper 24 is detected, the control unit 502 controls the pick-up roller 81 to terminate the first operation to stop movement of the sheet of paper 24 (t3 in FIG. 8). The stopped sheet of paper 24 stands by without movement until the point of time of second operation (t4 in FIG. 8) of the pick-up roller 82. Because the forward roller 82 and the retard roller 83 rotate in a fixed position and the feed sensor 85 is also mounted to a fixed position, a distance from a contact point between the forward roller 82 and the retard roller 83 to the detection point of the feed sensor 85 is constant. Accordingly, a position where the sheet of paper 24 is stopped in response to the detection of the front end of the sheet of paper 24 by the feed sensor 85 is also constant. Therefore, although the front ends of the sheets of paper loaded in the main paper container 118 may be misaligned or uneven, all the sheets of paper picked up by the pick-up roller 81 are stopped and stand by at the same position in response to the detection by the feed sensor 85. As a result, the same effect as when the sheets of paper are picked up in such a state that the front ends of all the sheets of paper are evenly aligned is obtained.

While the picked-up sheet of paper 24 stands by, if a predetermined second time (tb=t4−t1) passes since the starting point of time (t1 in FIG. 8) of the first operation of the pick-up roller 81, the control unit 502 controls the pick-up roller 81 to start second operation (t4 through t5 in FIG. 8). By the second operation of the pick-up roller 81, the front end of the sheet of paper 24, which has stopped and has stood by since the point of time t3, starts moving again and reaches the feed roller 84. The second operation of the pick-up roller 81 is terminated when a predetermined third time (tc=t5−t1) passes since the point of time (t1 in FIG. 8) when the pick-up roller 81 is initially driven. The predetermined third time tc is time until the front end of the picked-up sheet of paper 24 reaches the feed roller 84 and thus the movement of the sheet of paper 24 may be achieved only by the feed roller 84 without operation of the pick-up roller 81. In other words, the movement of the sheet of paper 24 may be achieved by the pick-up roller 81 before the point of time t5, but the movement of the sheet of paper 24 may be achieved by the feed roller 84 after the point of time t5. If the sheet of paper 24 is moved by the feed roller 84 and the rear end of the sheet of paper 24 passes through the feed sensor 85 (t6 in FIG. 8), detection of the sheet of paper 24 by the feed sensor 85 is completed.

The starting point of time t4 of the second operation of the pick-up roller 81 is when the predetermined second time tb passes since the starting point of time t1 of the first operation of the pick-up roller 81. Because the predetermined second time tb starts from the starting point of time of the first operation of the pick-up roller 81, although the front ends of the sheets of paper loaded in the main paper container 118 may be misaligned or uneven, the first operation time and the second operation time of the pick-up roller 81 are always constant. Accordingly, the time taken for the sheet of paper in the main paper container 118 to reach the feed roller 84 is always constant.

As illustrated in FIG. 8, even though the front ends of the sheets of paper loaded in the main paper container 118 may be misaligned or uneven, all the sheets of paper picked up by the pick-up roller 81 always stop and stand by at the same position in response to the detection by the feed sensor 85 (refer to the explanation of t3 in FIG. 8). Therefore, the same effect as when the sheets of paper are picked up in such a state that the front ends of all sheets of paper are evenly aligned is obtained. Since all the sheets of paper are aligned at the same position and then are moved to the feed roller 84, deviation (i.e., uneven state) of the front ends of the sheets of paper is resolved when the sheets of paper are fed. The "same position" may be defined as a position to which the sheet of paper 24 advances during the time to since the point of time of detecting the front end of the sheet of paper 24 by the feed sensor 85. Since all the sheets of paper are moved to the feed roller 84 from the same position, it may be unnecessary to consider deviation of the front ends of the sheets of paper. Accordingly, when the plural sheets of paper are successively fed, it may be unnecessary to set a margin considering deviation of the front ends for an interval between sheets of paper (i.e., a feeding interval between a preceding sheet of paper and a succeeding sheet of paper).

Although the front ends of the sheets of paper loaded in the main paper container 118 may be misaligned or uneven, the starting point of time of movement and the moving time of the sheet of paper moving to the feed roller 84 by the pick-up roller 81 are always constant. The starting point of time t4 of the second operation of the pick-up roller 81, by which the device feeding the picked-up sheet of paper 24 is switched from the pick-up roller 81 to the feed roller 84, is not decided relatively to the irregular point of time, i.e., the point of time t2 of detecting the front end of the sheet of paper 24 by the feed sensor 84, but is decided relatively to the regular point of time, i.e., the point of time t1 of starting the first operation of the pick-up roller 81. Accordingly, although the front ends of the sheets of paper to be picked up are misaligned or uneven, the point of time at which the picked-up sheet of paper starts to move to the feed roller 84 and the moving time to the feed roller 84 are held constant.

As such, since the feeding point of time and the feeding time of the sheets of paper are held constant regardless of deviation of the front ends of the sheets of paper, a feeding interval between the plural sheets of paper fed successively is reduced, which indicates that the feeding speed of the sheets of paper is increased and feeding operation is stabilized. From these effects, improvement of image quality and noise reduction and life extension of the developing device (e.g., photosensitive drum or the like) may also be anticipated.

Figure 9:
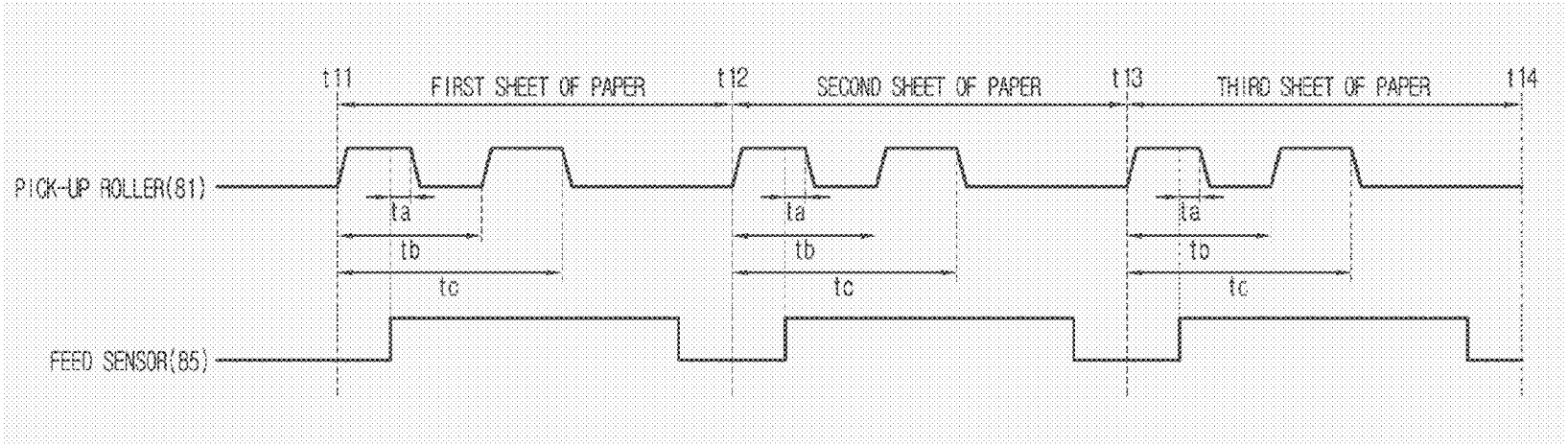
FIG. 9 is a view illustrating control signals and detection signals to feed a plurality of sheets of paper in the image forming apparatus according to an exemplary embodiment.

FIG. 9 is a view illustrating control signals and detection signals to feed a plurality of sheets of paper in the image forming apparatus according to an exemplary embodiment. In FIG. 9, a first sheet of paper is fed in a section t11 through t12, a second sheet of paper is fed in a section t12 through t13, and a third sheet of paper is fed in a section t13 through t14. Feeding of the unit sheet of paper in each section may be performed according to the method described above with reference to FIG. 8.

In the image forming apparatus 100 according to an exemplary embodiment, a feeding interval between two successive sheets of paper is decided according to Pages Per Minute (e.g., 30 ppm). Even though the sheets of paper are misaligned or uneven as illustrated in FIG. 6, the feeding interval may be held constant. If the print speed is 30 ppm, the feeding interval between the sheets of paper is 2 seconds (60 seconds/30). A reason why the feeding interval is maintained constant is that the point of time at which the picked-up sheet of paper starts to move to the feed roller 84 and the moving time to the feed roller 84 are always maintained constant by the feeding control based on detection of the sheet of paper by the feed sensor 85 (as described above with reference to FIG. 8) although the front ends of the sheets of paper to be picked up may be misaligned or uneven.

Figure 10:
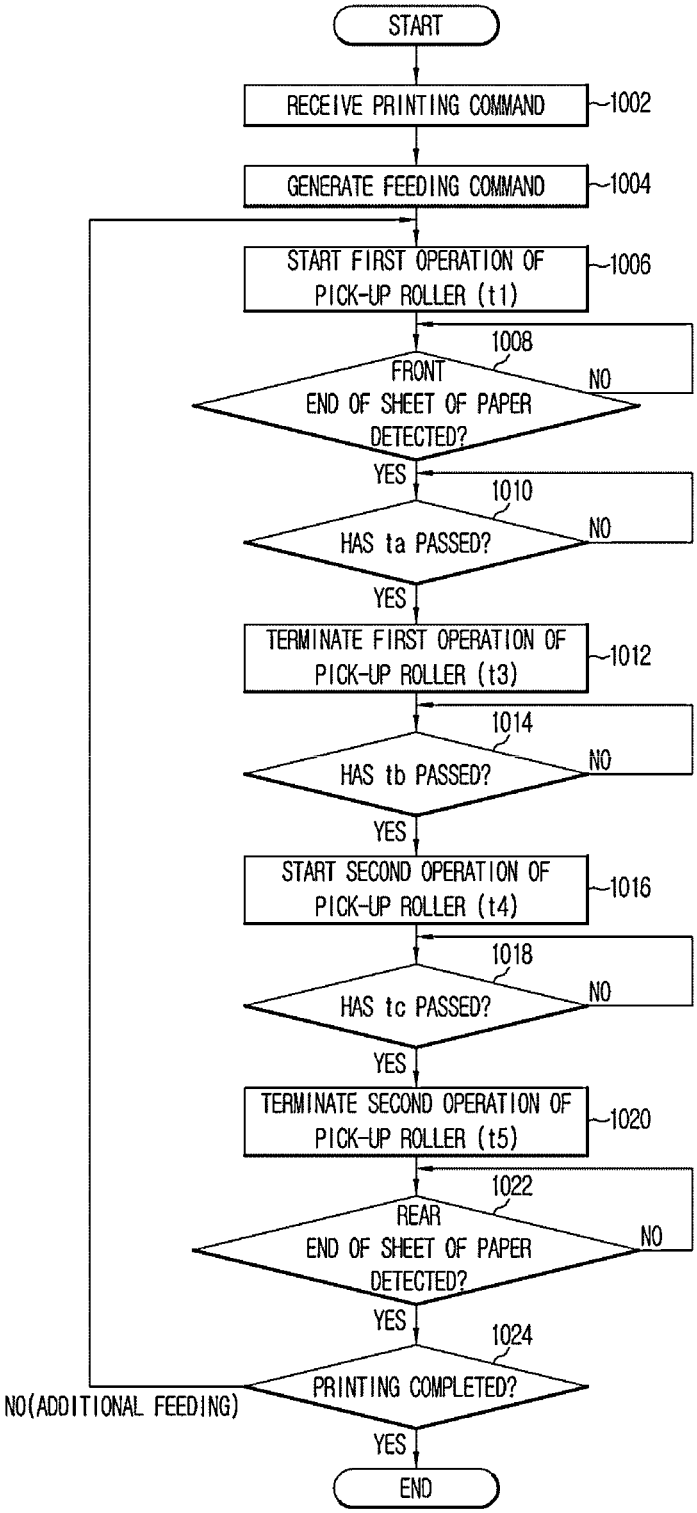
FIG. 10 is a control flowchart illustrating a method of controlling the image forming apparatus according to an exemplary embodiment.

FIG. 10 is a control flowchart illustrating a method of controlling the image forming apparatus according to an exemplary embodiment. In the method of controlling the image forming apparatus illustrated in FIG. 10, the sheet of paper to be printed may be fed through the feeding method based on the paper moving process illustrated in FIG. 8. As illustrated in FIG. 10, the control unit 502 receives a printing command generated when a user manipulates the manipulation device 126 or a printing command transmitted from a computer or the like that is connected to the image forming apparatus 100 at operation 1002. According to the received printing command, the control unit 502 generates a feeding command so that the sheet of paper moves to an engine unit for image formation to perform printing operation at operation 1004. If the feed command is generated, the pick-up roller 81 starts the first operation (t1 through t3 in FIG. 8) so that the sheet of paper 24 loaded on the knock-up plate 22 in the main paper container 118 is picked up (t1 in FIG. 8) so as to move toward the transfer belt 51 at operation 1006.

When the front end of the sheet of paper 24 picked up by the first operation of the pick-up roller 81 passes between the forward roller 82 and the retard roller 83 and moves by a predetermined distance and then passes by the feed sensor 85, the front end of the sheet of paper 24 is detected by the feed sensor 85 (t2 in FIG. 8) (YES at operation 1008). Subsequently, once the predetermined first time (ta=t3−t2) passes since the point of time t2 when the front end of the sheet of paper 24 is detected (YES at operation 1010), the control unit 502 terminates the first operation of the pick-up roller 81 (t3 in FIG. 8) to stop movement of the sheet of paper 24 at operation 1012. The stopped sheet of paper 24 stands by in a stationary state until the point of time (t4 in FIG. 8) of the second operation of the pick-up roller 82.

While the picked-up sheet of paper 24 stands by, if the predetermined second time (tb=t4−t1) passes since the starting point of time (t1 in FIG. 8) of the first operation of the pick-up roller 81 (YES at operation 1014), the control unit 502 starts the second operation (t4 through t5 in FIG. 8) of the pick-up roller 81 at operation 1016. By the second operation of the pick-up roller 81, the front end of the sheet of paper 24, which has stopped and has stood by since the point of time t3, starts moving again and reaches the feed roller 84. If the predetermined third time (tc=t5−t1) passes since the starting point of time (t1 in FIG. 8) of the first operation of the pick-up roller 81 (YES at operation 1018), the control unit 502 terminates the second operation of the pick-up roller 81 at point of time t5 at operation 1020. The predetermined third time tc is time until the front end of the picked-up sheet of paper 24 reaches the feed roller 84 and thus the movement of the sheet of paper 24 is achieved only by the feed roller 84 without operation of the pick-up roller 81. In other words, the movement of the sheet of paper 24 is achieved by the pick-up roller 81 before the point of time t5, but the movement of the sheet of paper 24 is achieved by the feed roller 84 after the point of time t5. If the sheet of paper 24 is moved by the feed roller 84 and the rear end of the sheet of paper 24 passes through the feed sensor 85 (t6 in FIG. 8), detection of the sheet of paper 24 by the feed sensor 85 is completed at operation 1022.

Detection of the rear end of the sheet of paper 24 by the feed sensor 85 indicates that picking-up of the sheet of paper 24 by the pick-up unit 80 is completed. If no more printing is needed, the printing operation is terminated (YES at operation 1024). If additional paper feeding is needed for more printing (NO at operation 1024), the control process goes back to operation 1006 at which the pick-up roller 81 performs the first operation, and repeats a series of paper feeding processes described above.

Figure 11:
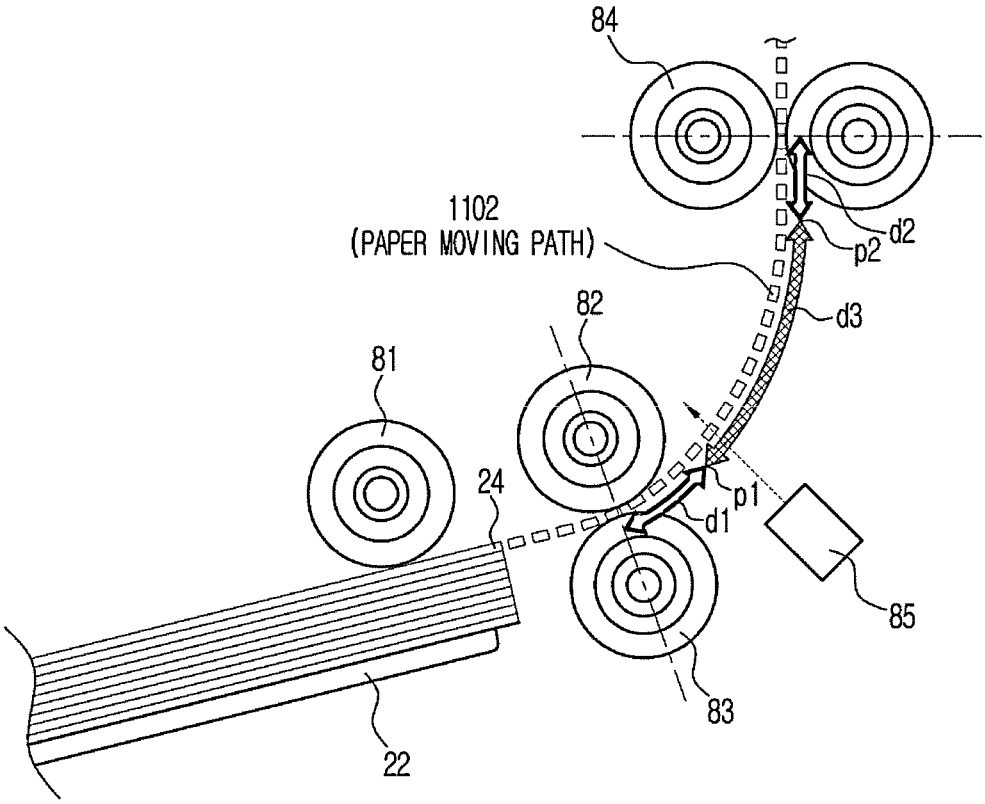
FIG. 11 is a view illustrating a mounting position of the feed sensor in the image forming apparatus according to an exemplary embodiment.

FIG. 11 is a view illustrating a mounting position of the feed sensor in the image forming apparatus according to an exemplary embodiment. In FIG. 11, a moving path 1102, along which the sheet of paper 24 loaded on the knock-up plate 22 is moved by the pick-up roller 81, the forward roller 82 and the feed roller 84, is illustrated by a dotted line. The mounting position of the feed sensor 85 may be determined so that a point at which the light irradiated from the feed sensor 85 intersects the moving path 1102 of the sheet of paper 24 is located within a region between a point on the moving path apart from the forward roller 82 and the feed roller 84 by a predetermined first distance d1 and a point on the moving path prior to the feed roller 84 by a predetermined second distance d2.

A mounting position of the feed sensor 85 may be determined such that the light irradiated from the feed sensor 85 passes through the paper moving path within a range between a first position P1 that is apart from a contact point of the forward roller 82 and the retard roller 83 by a first distance d1 or more in a direction toward the feed roller 84 (downstream of the paper moving direction) and a second position P2 that is apart from a contact point of the pair of feed rollers 84 by a predetermined second distance d2 or more in a direction toward the forward roller 82 (upstream of the paper moving direction).

In FIG. 11, the predetermined first distance d1 corresponds to a maximum value by which the front end of the sheet of paper 24 sticks out past the forward roller 82 toward the downstream side of the paper moving path. In other words, if the sheets of paper loaded in the main paper container are misaligned or uneven, the front ends of the sheets of paper may stick out by the first distance d1 toward the downstream side of the paper moving path. If the feed sensor 85 is mounted too close to the forward roller 82, the feed sensor 85 may erroneously detect the front end portion of the sheet of paper that sticks out due to misalignment, which may not fulfill the purpose that all the sheets of paper are kept aligned at the constant position (refer to point t3 in FIG. 8). To solve this problem, it may be desirable to mount the feed sensor 85 so that the light irradiated from the feed sensor 85 passes through the position apart from the forward roller 82 and the retard roller 83 by the predetermined first distance d1 or more toward the downstream side of the paper moving path.

In FIG. 11, the predetermined second distance d2 corresponds to a maximum time taken until a motor driving the pick-up roller 81 is stopped. Although the power supplied to the motor driving the pick-up roller 81 is cut off to stop rotation of the pick-up roller 81, the pick-up roller 81 does not stop immediately but rotates further due to rotational inertia of the motor or pick-up roller 81, by which the sheet of paper 24 moves further by the predetermined second distance d2. Accordingly, if the feed sensor 85 is mounted too close to the feed roller 84 without consideration of the second distance d2 due to the rotational inertia of the pick-up roller 81, the detection of the sheet of paper 24 is performed without regard for the additional moving distance of the sheet of paper 24 due to the rotational inertia of the pick-up roller 81, which may cause misdetection of the moving state of the sheet of paper 24. To solve this problem, it may be desirable to mount the feed sensor 85 so that the light irradiated from the feed sensor 85 passes through the position apart from the feed roller 84 by the predetermined second distance d2 or more toward the upstream side of the paper moving path.

For the aforementioned reasons, it may be desirable to set a distance between the forward roller 81 and the feed roller 84 in consideration of the predetermined first distance d1 and second distance d2 and a spare region d3 therebetween.

Although a few embodiments have been illustrated and described, it would be appreciated by those skilled in the art that changes may be made in these embodiments without departing from the principles and spirit of the invention, the scope of which is defined in the claims and their equivalents.

What is claimed is:

1. An image forming apparatus comprising:

a pick-up roller configured to pick up a sheet of paper loaded in a paper container and start a movement of the picked up sheet of paper along a paper moving path by performing a first operation at least at a first time;

a forward roller configured to feed the sheet of paper picked up by the pick-up roller and moving along the paper moving path toward a downstream side of the paper moving path;

a feed roller configured to feed the sheet of paper fed by the forward roller toward the downstream side of the paper moving path;

a feed sensor mounted between the forward roller and the feed roller configured to detect movement of the sheet of paper moving from the forward roller to the feed roller, to generate a first detection signal by detecting a front end of the sheet of paper at a second time, and to generate a second detection signal by detecting a rear end of the sheet of paper; and a controller configured to control the pick-up roller to:

terminate the first operation to stop the movement of the sheet of paper at a third time upon a predetermined first amount of time passing after the second time and not restarting movement of the stopped sheet of paper until a fourth time, perform a second operation to restart the movement of the stopped sheet of paper toward the downstream side of the paper moving path at the fourth time upon a predetermined second amount of time passing after the first time; and terminate the performing of the second operation, which restarted the movement of the stopped sheet of paper, when a predetermined third amount of time passes since a point of time when the pick-up roller is initially driven.

2. The image forming apparatus according to claim 1, wherein the feed sensor is mounted apart from the forward roller and the feed roller by respective predetermined distances within a region between the forward roller and the feed roller.

3. The image forming apparatus according to claim 2, wherein the predetermined distances include a predetermined first distance that is set from the forward roller toward the downstream side of the paper moving path, and a predetermined second distance that is set from the feed roller toward an upstream side of the paper moving path.

4. The image forming apparatus according to claim 3, wherein the predetermined first distance corresponds to a maximum value by which a front end of the sheet of paper passing through the forward roller sticks out past the forward roller toward the downstream side of the paper moving path.

5. The image forming apparatus according to claim 3, wherein the predetermined second distance corresponds to a maximum time taken until a motor driving the pick-up roller is stopped.

6. The image forming apparatus according to claim 5, wherein the motor driving the pick-up roller is stopped when rotational inertia of the motor is stopped after power supplied to the motor is cut off.

7. The image forming apparatus according to claim 1, wherein the feed sensor is configured to detect movement of the sheet of paper by irradiating light and receiving the light reflected from a surface of the sheet of paper.

8. The image forming apparatus according to claim 1, further comprising:

a transfer roller to form an image on the sheet of paper by pressurizing the sheet of paper fed by the feed roller against a transfer body.

9. The image forming apparatus according to claim 8, wherein the transfer roller is disposed at the downstream side of the paper moving path apart from the feed roller.

10. A method of controlling an image forming apparatus comprising:

starting a first operation at a first time of a pick-up roller picking up and moving a sheet of paper along a moving path from a forward roller to a feed roller of the image forming apparatus;

detecting at a second time a front end of the sheet of paper that is moving along the moving path from the forward roller to the feed roller;

terminating the first operation of the pick-up roller to stop the movement of the sheet of paper at a third time upon a predetermined first amount of time passing after the second time and not restarting movement of the stopped sheet of paper until a fourth time;

performing a second operation of the pickup roller to restart the movement of the stopped sheet of paper toward the downstream side of the paper path at the fourth time upon a predetermined second amount of time passing after the first time of the starting of the first operation of the pick-up roller; and terminating the performing of the second operation of the pickup roller, which restarted the movement of the sheet of paper, when a predetermined third amount of time passes since a point of time when the pick-up roller is initially driven.

11. The method according to claim 10, further comprising upon detecting a rear end of the sheet of paper by a feed sensor of the image forming apparatus completing the detection of the sheet of paper by the feed sensor, wherein the front end of the sheet of paper reaches the feed roller by the second operation of the pick-up roller.

12. The method according to claim 10, further comprising:

feeding the sheet of paper toward the downstream side of the paper moving path using the feed roller.

13. The method according to claim 12, wherein the predetermined second amount of time is longer than the predetermined first amount of time.

14. The method according to claim 13, wherein a feed sensor is mounted between the forward roller and the feed roller, and the predetermined third amount time is longer than the predetermined second amount of time.

15. The method according to claim 10, wherein the feed sensor is mounted apart from the forward roller and the feed roller by respective predetermined distances within a region between the forward roller and the feed roller.

16. The method according to claim 15, wherein the predetermined distances include a predetermined first distance that is set from the forward roller toward the downstream side of the paper moving path, and a predetermined second distance that is set from the feed roller toward an upstream side of the paper moving path.

17. The method according to claim 16, wherein the predetermined first distance corresponds to a maximum value by which a front end of the sheet of paper passing through the forward roller sticks out past the forward roller toward the downstream side of the paper moving path.

18. The method according to claim 16, wherein the predetermined second distance corresponds to a maximum time taken until a motor driving the pick-up roller is stopped.

19. The method according to claim 18, wherein the motor driving the pick-up roller is stopped when rotational inertia of the motor is stopped after power supplied to the motor is cut off.

* * * * *